United States Patent [19]

Sherrill et al.

[11] Patent Number: 4,791,580

[45] Date of Patent: Dec. 13, 1988

[54] DISPLAY PROCESSOR UPDATING ITS COLOR MAP MEMORIES FROM THE SERIAL OUTPUT PORT OF A VIDEO RANDOM-ACCESS MEMORY

[75] Inventors: James V. Sherrill, Knox County, Tenn.; David L. Sprague, Mercer County, N.J.

[73] Assignee: Technology Inc. 64, Princeton, N.J.

[21] Appl. No.: 918,552

[22] Filed: Oct. 14, 1986

[30] Foreign Application Priority Data

Jun. 18, 1986 [GB] United Kingdom ..... 8614874

[51] Int. Cl.[4] ..... G09G 1/16

[52] U.S. Cl. ..... 364/521; 340/703; 340/750; 340/799

[58] Field of Search ..... 364/518–522; 340/701, 703, 720, 750, 798–800

[56] References Cited

U.S. PATENT DOCUMENTS

| | | | |
|---|---|---|---|
| 4,200,867 | 4/1980 | Hill | 340/703 |
| 4,439,759 | 3/1984 | Fleming et al. | 340/703 |
| 4,484,187 | 11/1984 | Brown et al. | 340/703 |
| 4,564,915 | 1/1986 | Evans et al. | 340/701 X |
| 4,628,305 | 12/1986 | Ikeda | 340/799 X |
| 4,628,489 | 12/1986 | Ong et al. | 340/798 X |
| 4,635,048 | 1/1987 | Nishi et al. | 340/799 X |
| 4,663,619 | 5/1987 | Staggs et al. | 340/799 X |

*Primary Examiner*—Gary V. Harkcom
*Assistant Examiner*—H. R. Herndon
*Attorney, Agent, or Firm*—Joseph S. Tripoli; Eric P. Herrmann

[57] ABSTRACT

A display processor for a computer with graphics capability includes color map memories addressed by portions of pixel codes during display line trace intervals. The read-outs from these color map memories provide the primary color component signals from which the drive signals for the display monitor kinescope are derived. The pixel codes, from which color map memory addresses are derived, are supplied at video rate to the display processor from the serial output port of dual-ported video random access memory. The color map memories are loaded with new color map data during display retrace intervals. By supplying this new color map data from the serial port of the dual-ported video random-access memory, the color map memories can be rapidly updated.

2 Claims, 3 Drawing Sheets

DISPLAY PROCESSOR UPDATING ITS COLOR MAP MEMORIES FROM THE SERIAL OUTPUT PORT OF A VIDEO RANDOM-ACCESS MEMORY

The invention relates to display processors as used in computers for translating pixel data from image memories into linear codes descriptive of the amplitudes of primary color components of image pixels.

BACKGROUND OF THE INVENTION

These primary color components may be the additive primary color components red, green and blue, for example. Alternatively, these primary color components may be a luminance-only primary color and two chrominance-only primary colors, which by appropriate color matrixing can be converted to the additive primary colors. The invention can even have application to display processors operating with only one primary color component, such as luminance-only primary color.

In certain computers images are stored in image memory according to bit-map-organization. Each picture element or "pixel" is stored in a respective location in image memory. During each display field the image memory storage locations are addressed sequentially in synchronism with the tracking of scan lines on the computer display monitor; which conventionally uses a raster-scanned cathode ray tube or kinescope. In small computers the image memory is often included in the computer main memory, which is generally a dynamic memory. The display processor receives display information from an output port of the main memory. Recently so called video random access memories (VRAMs) have become commercially available. VRAMs are dual-ported memories having a random access input/output port and having a serial output port. This serial output port is at the end of a shift register in main memory, the successive stages of which shift register are side-loaded in parallel with descriptions of a scan line of successive image pixels during retrace intervals preceding line retrace intervals. The time taken for side-loading is essentially the same as the time for reading out from the random access port, but all the locations in a row are read out in parallel. Then, to supply pixel data to the display processor, this shift register is serially read out through the serial output port during each line trace interval. The shift register can be operated at high shift rate to supply pixel data at video rates, without the memory consuming excessive power. To get apparently higher shift rates, while keeping power consumption under control, the shift register can be constructed for banked operation using poly-phase shift clocks. Successive locations in the dual ported memory can be read row by row through the serial output port of the dual-ported memory at much higher rate, then, than the normal duty cycle of the memory operated for writing into or reading from a location via the random access port.

The other port of the main memory is the random access input/output port. This random access port is available for writing data into memory or reading data out of memory. Using this random access port, image data can be written into or deleted from the portions of computer main memory assigned to be the image memory. Also, this random access port is customarily used for access to computer main memory for computational tasks other than supporting the display. The cycle times for writing into and reading out from this random access port are much longer than one cycle of the pixel scan rate frequency, in dual-ported memories presently available.

Each of the pixel descriptions stored in image memory could comprise linear codings of the primary color components, but this usually involves long codes. A respective color map memory is provided for storing values of each of the primary color components. The image memory stores pixel descriptions which are "pointers" used as read addresses for the color map memories. A short read address code can access multibit linear codings of each of the primary color components to describe any color closely.

(One of the primary color components may be selected to be a luminance-only component. A map memory storing values of luminance-only component is sometimes called a luminance map memory, and only the map memories storing values of the other two primary color components are referred to as color map memories. In this specification the term "color map memory" will be used generically for both types of map memories.)

The color map memories are customarily operated as read-only memories during display. But it has been found convenient in the prior art to alter the contents of the color map memories to more closely fit the needs of a particular display. So, the color map memories are usually random access memories operated as read-only memories during display. These color map memories have in the prior art been re-written using data from the random access port of computer main memory. This places substantial constraints on the rate at which the color map memories may be rewritten. The complete re-writing of color map memories with many entries is convenient to do only during field retrace intervals in the display and is the custom in the prior art. Re-writing of color map memories with few entries has been done, but normally the field retrace interval has been too short to substantially re-write the color map memories.

SUMMARY OF THE INVENTION

The present inventors advocate instead the re-writing of the color map memories from serial output port of video random-access memory used as computer main memory or as an image memory. The color map memories are random access memories that are smaller than the video random-access memory, which allows the cycle of operation at their random access input/output ports to be short enough in duration that these memories will accept pixel data at pixel scan rate from the serial output port of the video random-access memory. Accordingly, the color map memories can be re-written in their entirety or in substantial fraction of their entirety during display line retrace intervals. This capability permits new modes of display operation.

DETAILED DESCRIPTION

Figure 1:
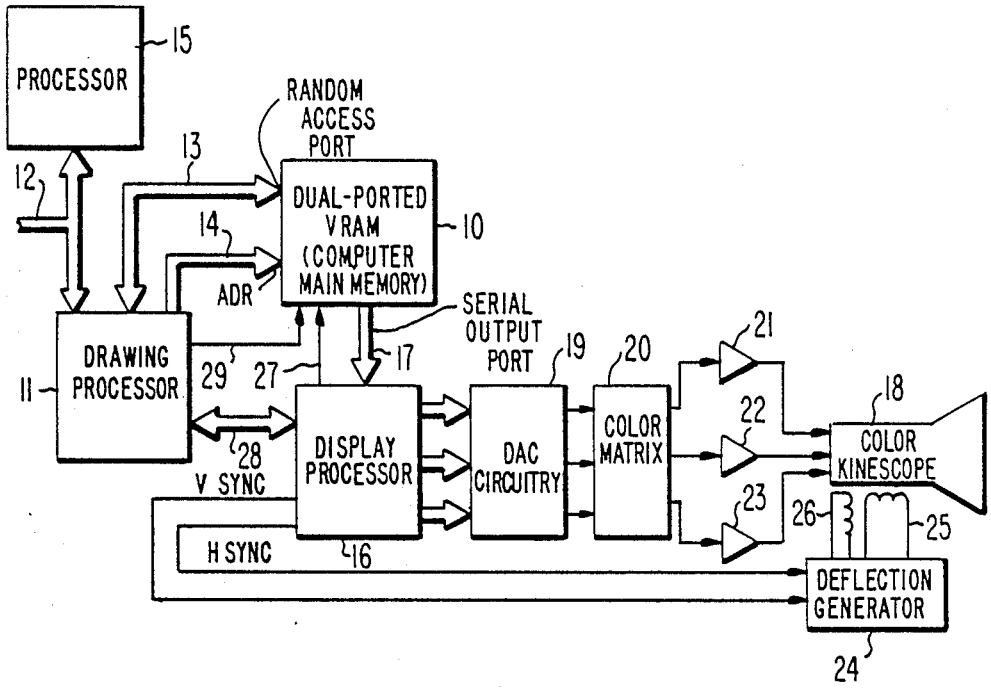
FIG. 1 is a block schematic diagram of a computer in which the invention is used.

In the FIG. 1 computer a dual-ported, dynamic, video random-access memory (VRAM) 10 serves as the computer main memory. Access to and from the random access input/output ports of VRAM 10 is controlled by circuitry within a drawing processor 11. Drawing processor 11 includes an internal random access memory for storing micro instructions in microcode, a microcode address sequencer, and a microde decoder. It includes a collection of functional blocks known collectively as "datapath". Datapath includes arithmetic and storage units similar to those found in a general purpose processor. These functional blocks perform the mathematical and logical operations needed to produce the bit maps stored in the image memory portions of VRAM 10. Datapath can include a two-dimensional spatial interpolator for pixels. Drawing processor 11 determines the partitioning of VRAM 10 between image and non-image portions thereof, and that partitioning can be programmable.

Drawing processor 11 can take in video data from the computer main system bus 12 and supply it via a bus 13 for writing into VRAM 10. Drawing processor 11 generates the addresses supplied via an address bus 14 as write addresses to VRAM 10 during this writing procedure. A general-purpose processor 15 such as a commercially available microprocessor, has access to main system bus 12. So processor 15 can write into VRAM 10 through drawing processor 11. More particularly, it can write into portions of the VRAM 10 partitioned by drawing processor 11 for use other than image storage. Drawing processor 11 will also permit processor 15 to access VRAM 10 random access port for reading data therefrom.

A display processor 16 receives data from the serial output port of VRAM 10 via a bus 17 and generates digital signals descriptive of the analog drive signals to be applied to the display monitor kinescope 18, shown as being a color kinescope. These digital signals are respectively converted to continuous analog signals by digital-to-analog converter circuitry 19. If these analog signals are not descriptive of red, green and blue additive-primary-color components, color matrixing circuitry 20 is customarily used to convert them to these additive-primary-color components. Video amplifiers 21, 22 and 23 provide amplified responses to these additive-primary-color component signals, which amplified responses are applied as drive signals to kinescope 18. If the analog signals from digital to analog converter circuitry 19 are invariably descriptive of red, green and blue additive-primary-color components, these signals may be applied directly to the inputs of video amplifiers 21, 22 and 23; and the color matrixing circuitry 20 may be dispensed with.

Display processor 16 includes therewithin synchronizing signal generation circuitry for generating horizontal synchronizing (H SYNC) and vertical synchronizing (V SYNC) pulses. The timing of these pulses is determined by counting the oscillations of a master clock generator. The H SYNC and V SYNC synchronizing pulses are supplied to a deflection generator 24 which generates the deflection signals applied to the deflection apparatus of kinescope 18, shown in FIG. 1 as comprising a horizontal deflection coil 25 and vertical deflection coil 26.

The counting of oscillations of the master clock generator, which oscillates at a frequency that is a multiple of pixel scan rate, also generates trains of pixel scan rate pulses that are supplied from display processor 16 to VRAM 10. These trains of pulses forward clock the shift register supplying the serial output port of VRAM 10 with pixel data to be transmitted via bus 17 to display processor 16.

The counting of oscillations of the master clock generator also generates update requests transmitted from display processor 16 to drawing processor 11 via a plural-bit bus 28. Drawing processor 11 includes a sequencer which steps through successive image memory row addresses an update requests are received. At each update interval, the row address is supplied from drawing processor 11 to VRAM 10 via address bus 14, and drawing processor 11 issues a command via connection 29 to VRAM 10 for parallelly loading the successive stages of the shift register which will subsequently supply the data sequentially to VRAM 10 serial output port. The coutdown circuitry of display processor 16 also supplies, via bus 28, instructions to reset the row address sequencer, in drawing processor 11, after each frame of display.

Display processor 16 includes pixel unwrapping circuitry for dividing into successive pixels the data transmitted to it via bus 17 from VRAM 10 serial output port, supposing that the data is transmitted in increments other than per pixel. This pixel unwrapping circuitry includes parallel storage for the bits in two (or in one and a part) successive read-outs from VRAM 10 serial output port. The pixel unwrapping circuitry includes a multiplexer for selecting pixels at pixel scan rate, which multiplexer is under control of a sequencer.

Figure 2:
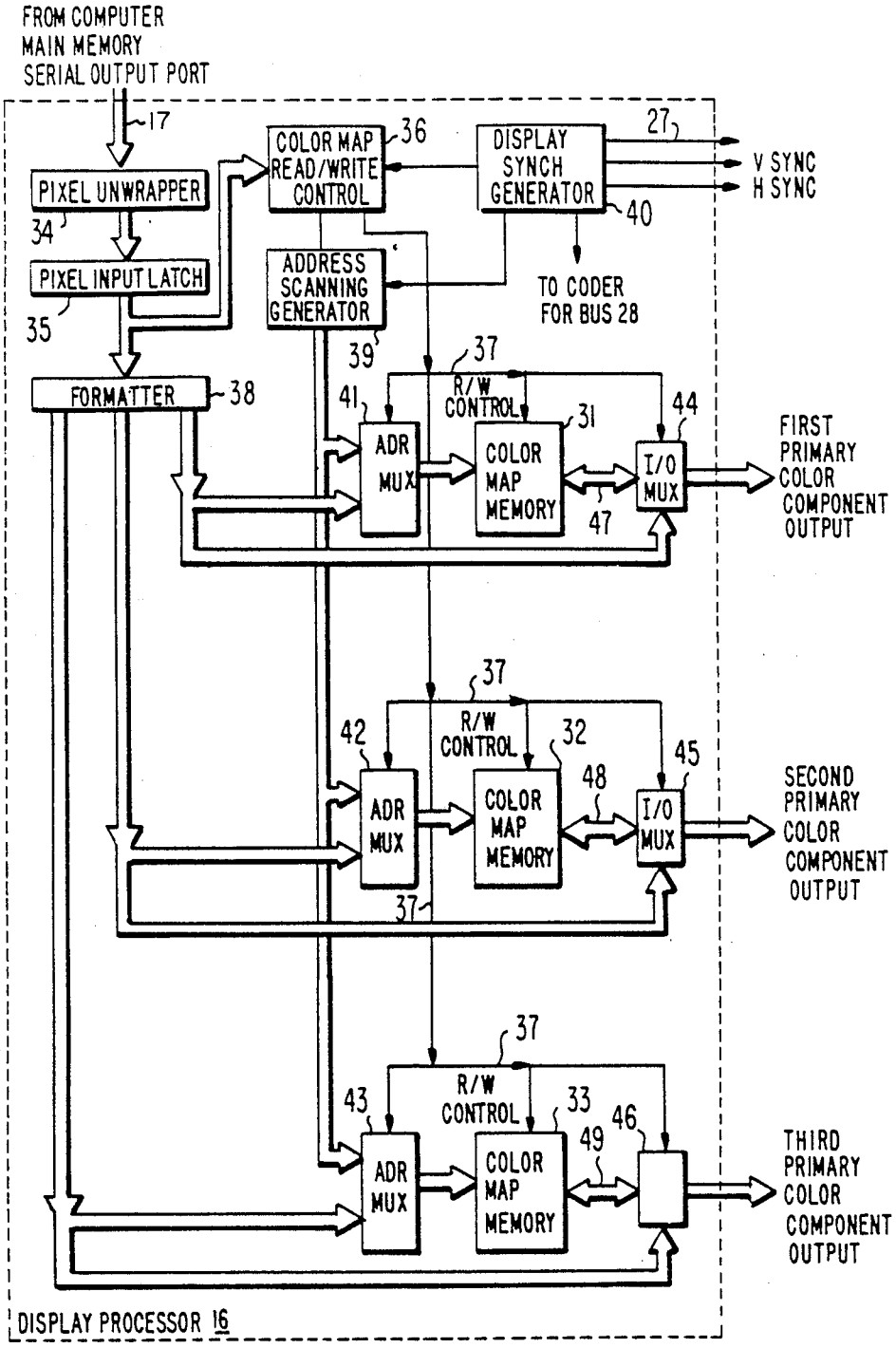
FIG. 2 is a detailed block schematic diagram of the display processor in the FIG. 1 computer, showing the color map memories and the circuitry for selectively reading and writing them.

The operations thusfar described write the display information contained in the image memory portions of VRAM 10 on the screen of color kinescope 18. FIG. 2 is useful in understanding how color map memories 31, 32 and 33 are employed in display processor 16 and how in the invention these color map memories are re-written from the serial output port of VRAM 10.

In FIG. 2 the successive data read out from VRAM 10 serial output port and routed via bus 17 to display processor 16 are supplied to a pixel unwrapper 34, supposing VRAM 10 serial output is not furnished on a per pixel basis. Successive pixel descriptions, or pixel codes, supplied from pixel unwrapper 34 (or from bus 17 when pixel unwrapper 34 is not necessary because VRAM 10 serial output is invariably furnished on a per pixel basis) are successively admitted (one each pixel scan rate cycle) into a pixel input latch 35.

Color map read/write control circuitry 36 controls the reading and writing of the color map memories 31, 32 and 33. A display sync generator 40 in display processor 16 supplies to control circuitry 36 the timing information required to determine whether or not display is being currently written using read-outs from color map memories 31, 32 and 33. If the display is not being written, the color map read/write control circuitry 36 is conditioned to ingest color map writing instructions VRAM 10 has supplied to input pixel latch 35.

Consider first the operating conditions when the display is being written from the read-outs of color map memories 31, 32 and 33. Responsive to the timing information from display sync generator 40, indicating that the display is currently being written, color map read/-write control circuitry 36 establishes a first voltage condition (e.g. a ONE) on its connection 37 to color map memories 31, 32 and 33; to address multiplexers 41, 42 and 43; and to input/output multiplexers 44, 45 and 46. This first voltage conditions color map memories 31, 32 and 33 to be read. Input/output multiplexers 44, 45 and 46 are conditioned to connect the respective input-/output busses 47, 48 and 49 of color map memories 31, 32 and 33 to deliver, as respective read outputs, the first, second and third primary color outputs in digital form. Address multiplexers 41, 42 and 43 are conditioned to connect the address inputs of color map memories 31, 32 and 33 to respective outputs of a formatter 38, rather than to the output of an address scanning generator 39 used during the writing of color map memories 31, 32 and 33.

During the reading of color map memories 31, 32 and 33 to display an image on the screen of color kinescope 18, formatter 38 supplies addresses to color map memories 31, 32 and 33 which decode the portions of the pixel codes respectively descriptive of the first, second and third primary color components. Formatter 38 selects a first portion of the pixel code supplied to it from the pixel input latch 35, for address multiplexer 41 to apply as a read address to color map memory 31. Formatter 38 selects a second portion of the pixel code supplied to it from the pixel input latch 35, for address multiplexer 42 to apply as a read address to color memory 32. Formatter 38 selects a third portion of the pixel code supplied to it from the pixel input latch 35, for address multiplexer 43 to apply as a read address to color map memory 33. Formatter 38 may be of a type described in detail in U.S. application Ser. No. 918,305 concurrently filed by L. D. Ryan et al. entitled "DISPLAY PROCESSORS ACCOMMODATING THE DESCRIPTION OF COLOR PIXELS IN VARIBLE-LENGTH CODES" and assigned to RCA Corporation. In such case formatter 38 may be programmed to select the same bits in the pixel input latch 35 as read address for all these color map memories 31, 32 and 33. This operates the color map memories during their reading in a way similar to prior-art practice. Alternatively, formatter 38 may select independent groups of bits from pixel input latch 35 as respective read addresses for color map memories. Still further, formatter 38 may be of a type selecting similar read addresses for two of the color map memories 31, 32 and 33 and a separate read addresses for the other color map memory.

When color map read/write control circuitry 36 receives, from display synch generator 40, an indication that line trace interval is over, the control circuitry 36 is subsequently conditioned to receive an instructions header supplied by VRAM 10 through its serial output port. These instructions were previously written into VRAM 10 using the drawing processor 11. These instructions are shown being taken into control circuitry from pixel input latch 35, though they may be taken off bus 17 by another route. These instructions specify how color map memories 31, 32 and 33 are or are not to have their contents re-written. After a period of time to ingest the instructions, if re-writing of the color map memories is instructed, the read/write control circuitry 36 places a second voltage level (e.g. a ZERO) on connection 37. This second voltage conditions color map memories 31, 32 and 33 to be written.

This second voltage level conditions the address multiplexers 41, 42 and 43 to apply output from the address scanning generator 39 as write addresses to the address inputs of color map memories 31, 32 and 33. The address scanning generator 39 scans those addresses which are to be re-written in the color map memories 31, 32 and 33. Generator 39 may simply comprise a counter to scan consecutive addresses in the color map memories 31, 32 and 33 for example. The instructions header will then carry information as to the range(s) over which the counter will count. Counting proceeds at address scan rate as the information to re-write color map memories 31, 32 and 33 is clocked through pixel input latch 35 at that address scan rate.

The second voltage level in connection 37 conditions input/output multiplexers 44, 45 and 46 to write into color map memories 31, 32 and 33, via their respective input/output buses 47, 48 and 49, respective ones of the formatter 38 outputs. With the instruction header past, the pixel input latch receives the write inputs for the color map memories 31, 32 and 33 in parallel. Formatter 38 selects the respective write inputs for color map memories 31, 32 and 33 to their respective input/output multiplexers 44, 45 and 46.

In a conventional display monitor, the line retrace interval is typically one-fifth as long as the line trace interval or slightly longer. Suppose that the color map memories 31, 32 and 33 had as many addressable storage locations as there were pixels in a display scan line, and suppose that the generator 39 address scan rate during writing were the same as pixel scan rate. Then, up to one-fifth of the color map memory contents could be rewritten during the line retrace interval. In the longer field trace interval comprising several line intervals (and an additional half line interval if field-to-field line interlace be used) the entire contents of color map memories 31, 32 and 33 can be re-written in a time equal in duration to a line trace interval, supposing generator 39 address scan rate to equal pixel scan rate.

In practice there are often systems design considerations that allow the number of addressable storage locations in the color map memories to be reduced so that the color map memories 31, 32 and 33 can be rewritten entirely within one display line retrace interval, even supposing the generator 39 address scan rate to equal the pixel scan rate. For example, the display processor 16 may be used solely to generate montage images that are to replace a background image supplied to the display screen by means other than display processor 16. If the montaged images are never wider in total than one-fifth of any display line trace interval color map memories 31, 32 and 33 can be re-written entirely within a display retrace interval.

The number of addressable locations in any one of the color map memories 31, 32 and 33 that needs to be rewritten during any line retrace interval is reduced when there are several pixels in a line or pair of adjacent lines that have the same value of the picture variable stored in that color map. Many images have considerable correlation amongst adjoining pixels. This is especially true where computer-generated graphics are concerned, but is also true to appreciable extent where camera-originated images are concerned.

A number of variants of the FIG. 2 display processor 16 as thusfar described are possible, which also embody the invention. The connection 37 may be replaced by three independent control lines: the first control line to memory 31 and to the pair of multiplexers 41 and 44; the second control line to memory 32 and to the pair of multiplexers 42 and 45; and the third control line to memory 33 and to the pair of multiplexers 43 and 46. This permits the independent control of reading and writing each of the color map memories 31, 32 and 33.

The same operation can be achieved by replacing connection 37 with a two-bit wide bus for transmitting read/write instructions in coded form, and by using appropriate instruction decoders in the color map memories 31–33 and the multiplexers 41–46. Independent address scanning generators may also be provided for color map memories 31, 32 and 33 during their writing.

It may be desirable to include a number of registers for storing control signals in the display processor 16 illustrated in FIG. 2. For example, where formatter 38 is programmable (as in the Ryan et al. formatter previously referred to), registers are desired for storing the instructions as to which of the bits in the pixel input latch 35 are to be selected to each of its outputs. Registers may also be desired for storing instructions as to spatial multiplexing of the addresses applied to the color map memories 31, 32 and 33. These registers are conveniently loaded from bus 17, at a time during field retrace interval other than when color map memories 31, 32 and 33 are loaded from bus 17. One may also arrange for the re-loading of these registers during line retrace intervals when color map memories 31, 32 and 33 are not being re-loaded.

Display processors incorporating the invention, but simpler than display processor 16, may be desired, despite the attendant losses in operating flexibility. Ryan et al. describe display processors in which a pair of color map memories receive addresses in common and store values of first and second chrominance-only primary color components—e.g. I and Q or (R−Y) and (B−Y). A luminance-only primary color component color map memory may be used with such an arrangement; or it may be dispensed with, with the luminance-only color component of each pixel being linearly coded to accommodate the non-use of the third color map memory.

Figure 3:
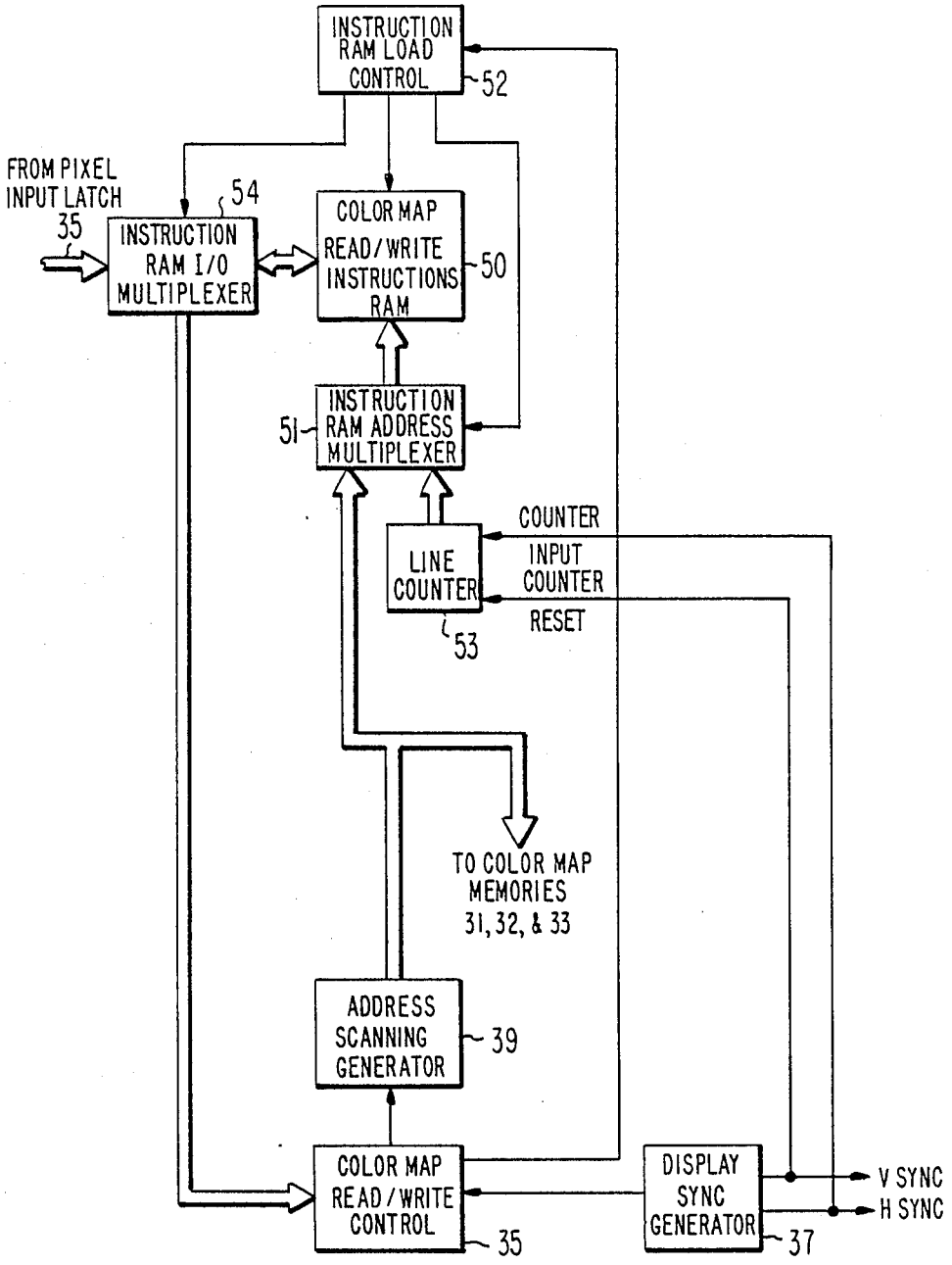
FIG. 3 is a block schematic diagram of a modification that can be made to the FIG. 2 display processor.

FIG. 3 shows a modification that can be made to the FIG. 2 display processor 16, to avoid having to use an instruction header preceding the writing of data into color map memories 31, 32 and 33 during display retrace intervals. This lengthens the time available during line retrace interval for re-writing color map memories 31, 32 and 33. A random access memory 50 is provided for storing the instructions that the color map read/write control circuitry 36' will execute each scan line. RAM 50 is addressed in terms of scan line numbers furnished to it from an instruction RAM address multiplexer 51. Load control circuitry 52 for RAM 50 controls the selection of the source of line scan numbers. During display scan, when instructions are read from RAM 50, a line counter 53 provides these scan line numbers. During the writing of RAM 50, these scan line numbers are supplied from address scanning generator 39.

RAM 50 is written during a designated time interval in th field retrace interval. The occurrence of this designated time is signaled by a write command issuing from display sync generator 40 to color map read/write control circuitry 36'. Circuitry 36' relays the write command to the load control circuitry 52 for instruction RAM 50 and conditions the address scanning generator 39 to provide write addresses to RAM 50. Load control circuitry 52 responds to the write command to condition input/output multiplexer 54 to accept pixel input latch 35 data as write input and to condition address multiplexer 51 to select (as write addresses) scan line numbers furnished by address scanning generator 39. Load control circuitry 52 supplies a write signal to RAM 50.

When the designated time interval for writing RAM 50 concludes, load control circuitry applies read signals to RAM 50, conditions multiplexer 51 to select (as read addresses) scan line numbers furnished by line counter 53, and conditions input/output multiplexer 54 to apply read outputs from RAM 50 to the color map read/write control circuitry 36'.

What is claimed is:

1. In a system, for providing data representing images for display on a display device, including a random-access memory for storing bit mapped image data and color map memory program data, said random-access memory having a serial output port, said system further including a display processor compising:

a display processor input port coupled to the serial output port of said random access memory;

a color map memory having an address input port and a data input/output port;

an address generator having an output port for providing address codes and having a control input port;

read/write control circuitry coupled to said display processor input port and responsive to data provided by said random access memory, and including;

(a) an output port coupled to the control input port of said address generator for controlling sequences of address codes produced thereby;

(b) means for selectively coupling said display processor input port or the output port of said address generator to the address input port of said color map memory; and (c) means for selectively coupling said display processor input port to the input/output port of said color map memory when the output port of said address generator is coupled to the address input port of said color map memory, whereby color map memory program data from said random access memory may be written into said color map memory.

2. The display processor set forth in claim 1 further including:

a second color map memory having an address input port and a data input/output port; and wherein said read/write control circuitry further includes (d) means for selectively coupling said display processor input port or the output port of said address generator to the address input/output port of said second color map memory; and (e) means for selectively coupling said display processor input port to the input/output port of said second color map memory when the ouput port of said address generator is coupled to the address input port of said second color map memory whereby color map memory program data from said random-access memory may be written into said second color map memory and wherein writing color map memory program data into said second color map memory may be performed independently of writing color map memory program data into said color map memory.

* * * * *